United States Patent [19]

Kim

[11] Patent Number: 4,601,499

[45] Date of Patent: Jul. 22, 1986

[54] OPERATING MECHANISM FOR A CLOSURE LATCHING ASSEMBLY

[75] Inventor: Kun H. Kim, Indianapolis, Ind.

[73] Assignee: Von Duprin, Inc., Indianapolis, Ind.

[21] Appl. No.: 627,722

[22] Filed: Jul. 3, 1984

[51] Int. Cl.[4] ..... E05C 1/12

[52] U.S. Cl. ..... 292/36; 70/461; 292/40; 292/139; 292/143; 292/DIG. 31; 292/DIG. 54; 292/DIG. 60; 411/352; 411/522

[58] Field of Search ..... 292/43, DIG. 60, DIG. 51, 292/3, 32, 36, 138, 139, 33, DIG. 54, 143, 113, 21, DIG. 31, 336.3, 92, 40; 411/337, 352, 353, 522, 523; 70/461

[56] References Cited

U.S. PATENT DOCUMENTS

| | | | |
|---|---|---|---|
| 40,875 | 12/1863 | Williams | 292/DIG. 60 X |
| 671,792 | 4/1901 | Comber | 292/DIG. 60 X |
| 742,875 | 11/1903 | Keverline | 292/DIG. 60 X |
| 1,003,956 | 9/1911 | Voight | 292/DIG. 60 X |
| 1,282,115 | 10/1918 | Older | 292/36 |
| 1,408,629 | 3/1922 | Palmer | 292/36 |
| 2,154,655 | 4/1939 | Bahan | 411/352 |
| 2,468,251 | 4/1949 | Wiederman | 292/36 X |
| 3,345,099 | 10/1967 | Paul et al. | 292/224 X |
| 3,434,103 | 3/1969 | Hancock et al. | 411/523 X |
| 3,563,585 | 2/1971 | Welch | 292/92 |
| 3,751,949 | 8/1973 | Castle | 292/36 X |
| 3,909,051 | 9/1975 | Nakai | 292/336.3 X |

FOREIGN PATENT DOCUMENTS

| | | | |
|---|---|---|---|
| 48615 | 4/1934 | Denmark | 292/36 |
| 850903 | 9/1939 | France | 292/36 |
| 954870 | 6/1949 | France | 292/36 |
| 155815 | 8/1956 | Sweden | 411/523 |

*Primary Examiner*—Gary L. Smith
*Assistant Examiner*—Lloyd A. Gall
*Attorney, Agent, or Firm*—Bernard J. Murphy

[57] ABSTRACT

The invention comprises the essential operating mechanism for a vertical latching assembly for a closure. It provides adjustment screws, accessibly disposed, externally of the closure (door), for adjusting the effective lengths of the elongate, latch bolt-actuating elements. A centercase, which is mounted externally of the door, has attachment blocks slidably coupled thereto. The blocks carry limbs, of the top and bottom bolt-actuating elements, or rod connectors, and the adjustment screws are threadedly engaged with the limbs for moving them, selectively and adjustably, axially of the centercase.

14 Claims, 7 Drawing Figures

FIG. 4
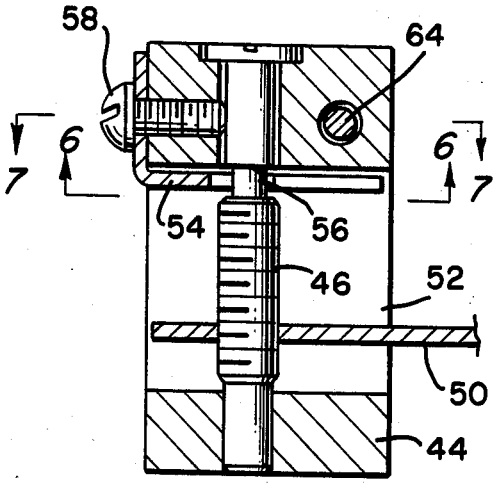
FIG. 7
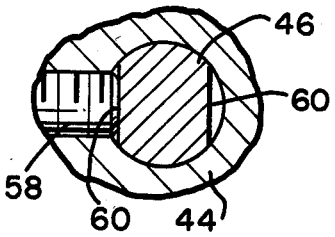
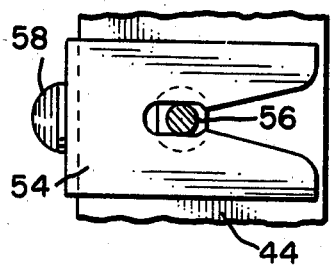
FIG. 6
FIG. 5
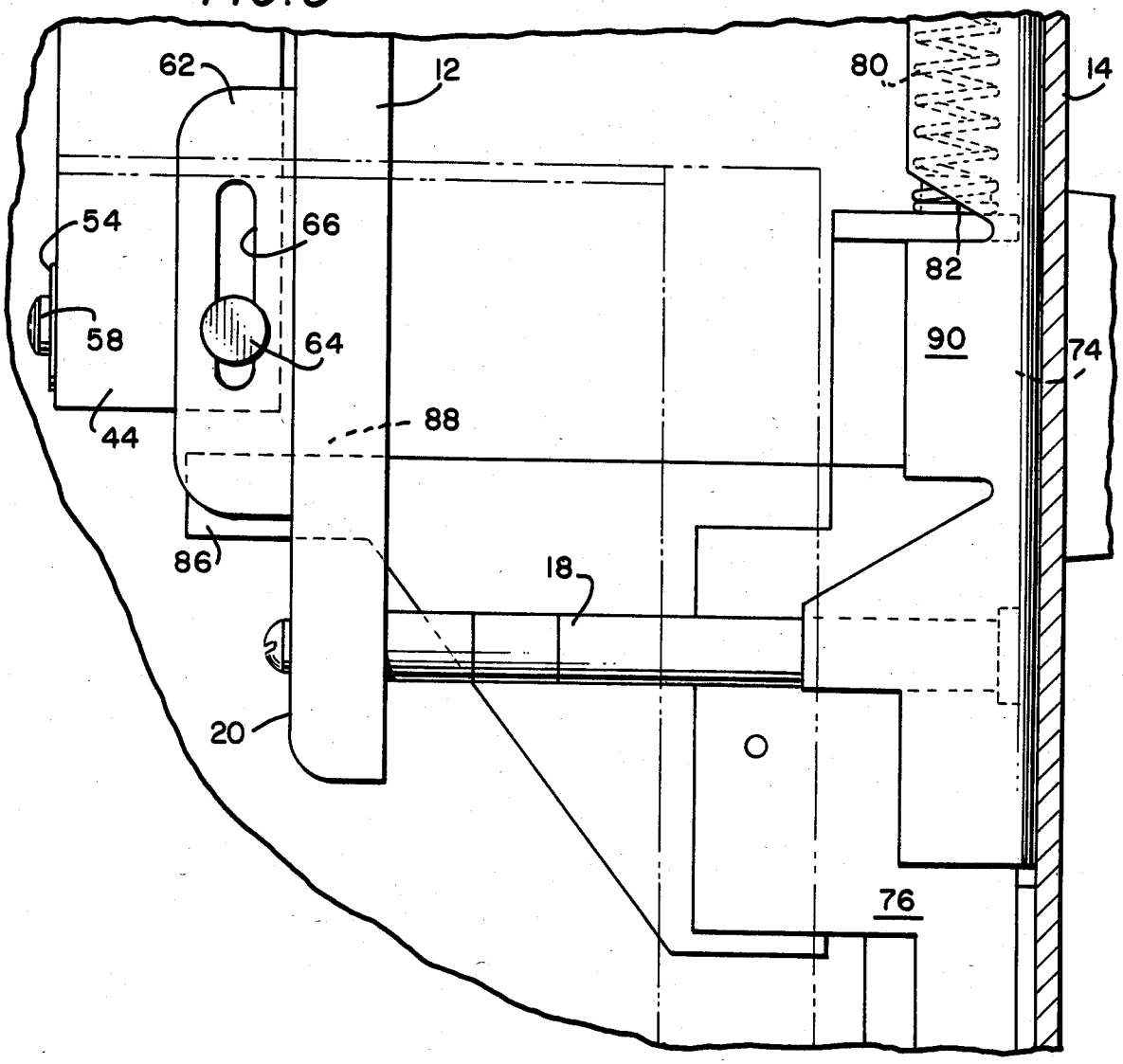

OPERATING MECHANISM FOR A CLOSURE LATCHING ASSEMBLY

This invention pertains to concealed rod, panic exit, door latching hardware, and in particular to the essential operating mechanism for such hardware. Exemplary of such hardware are U.S. Pat. Nos. 3,563,585, issued to Nicholas A. Welch, on Feb. 16, 1971, for "A Latch Unit for a Door Lock"; 3,582,122, issued to John R. Foster, et al., for an "Automatic Flush Bolt", on June 1, 1971; and 3,788,687, granted on Jan. 29, 1974, to George Z. Zawadzki, for a "Safety Exit Latch Bolt Retainer".

In the prior art, it has been exceedingly difficult to adjust the effective lengths of the latch bolt-actuating elements, i.e., the rod connectors, in concealed rod, panic exit-type, door latching mechanisms. Some of the prior art devices require some considerable mechanism disassembly to effect an adjustment of the rod connectors, and others provide a limited access, through the front of the door, to the inner portions of the mechanism, to make such adjustments internally thereof.

It is an object of this invention to disclose an improved operating mechanism for a closure latching assembly in which the adjustment of the rod connectors can be done with ease and simplicity from the outer surface of the centercase mounted externally on the door.

It is also an object of this invention to set forth an operating mechanism for a closure latching assembly, comprising a support plate, having a longitudinal axis, for mounting thereof onto an external surface of a closure, such as a door, gate, bulkhead, or the like; wherein said plate has an inner, closure-interfacing and closure-engaging surface, and an outer, opposite, support surface; an elongate, latch bolt-actuating element; and an attachment block; wherein said plate and said block together comprise means coupling said block, slidably, to one of said surfaces to accommodate movement of said block axially of said plate; said block and said element together comprise means attaching said element removably to said block, in a given disposition relative to said block, for movement of said element in common with said block; and said attaching means includes means, accessibly disposed on said outer, support surface, selectively adjustable for effecting relative movement, between said element and said block, for positioning said element, relative to said block, in selected dispositions other than said given disposition.

Further objects of this invention, as well as the novel features thereof, will become more apparent by reference to the following description, taken in conjunction with the accompanying figures in which:

FIG. 4 is a cross-sectional view taken along section 4—4 of FIG. 2;

FIG. 5 is a partial cross-section and enlarged illustration of the shuttle mounted on the trim plate, taken along section 5—5 of FIG. 3;

FIG. 6 is a cross-sectional view taken along section 6—6 of FIG. 4; and

FIG. 7 is a greatly enlarged cross-sectional view taken along section 7—7 of FIG. 4.

Figure 1:
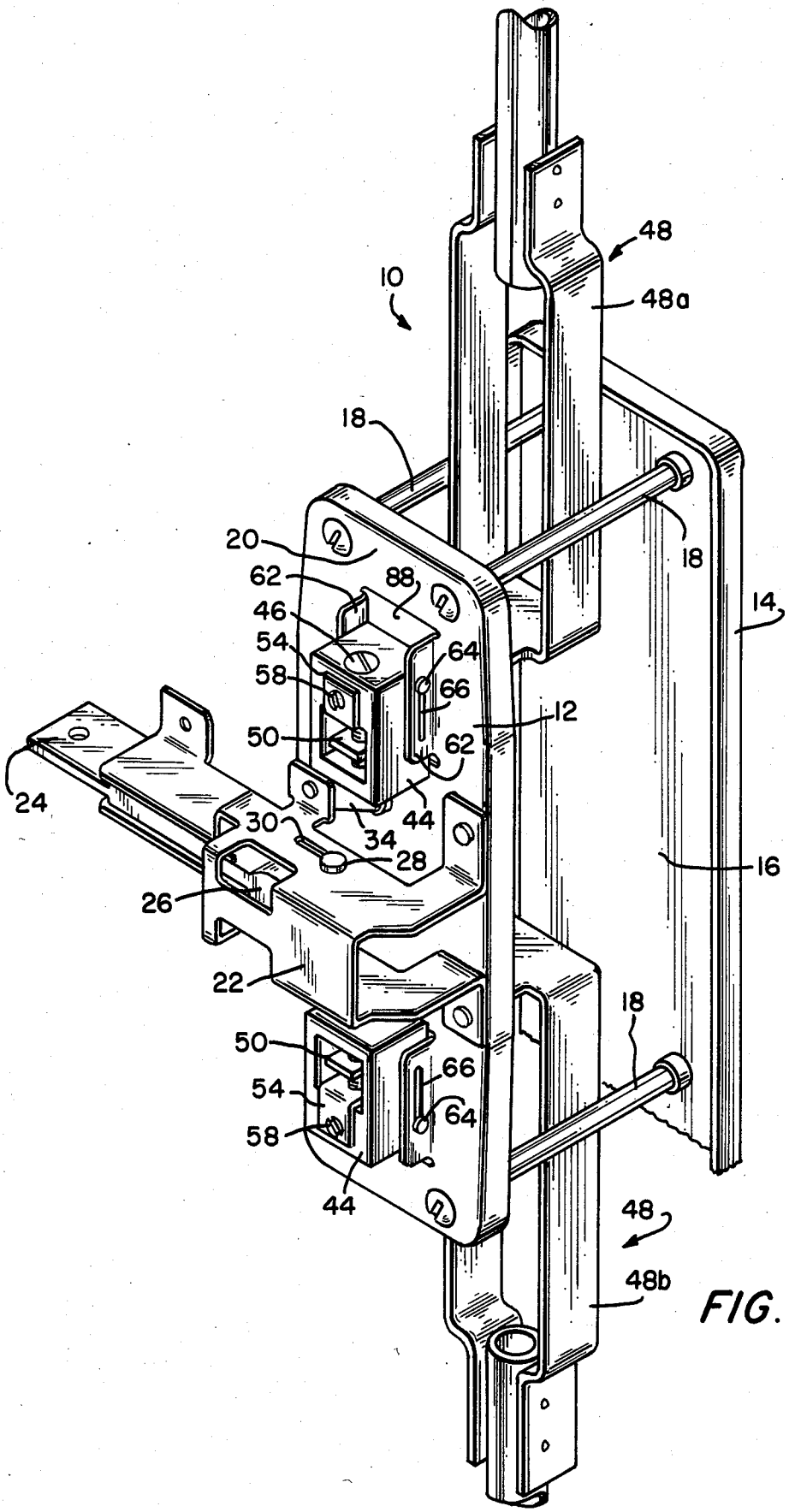
FIG. 1 is a perspective view of the novel mechanism, according to an embodiment thereof, showing in particular the operating components mounted on the centercase. The trim plate (a portion thereof) is shown connected thereto, without its mounted components only for purposes of reference.
Figure 2:
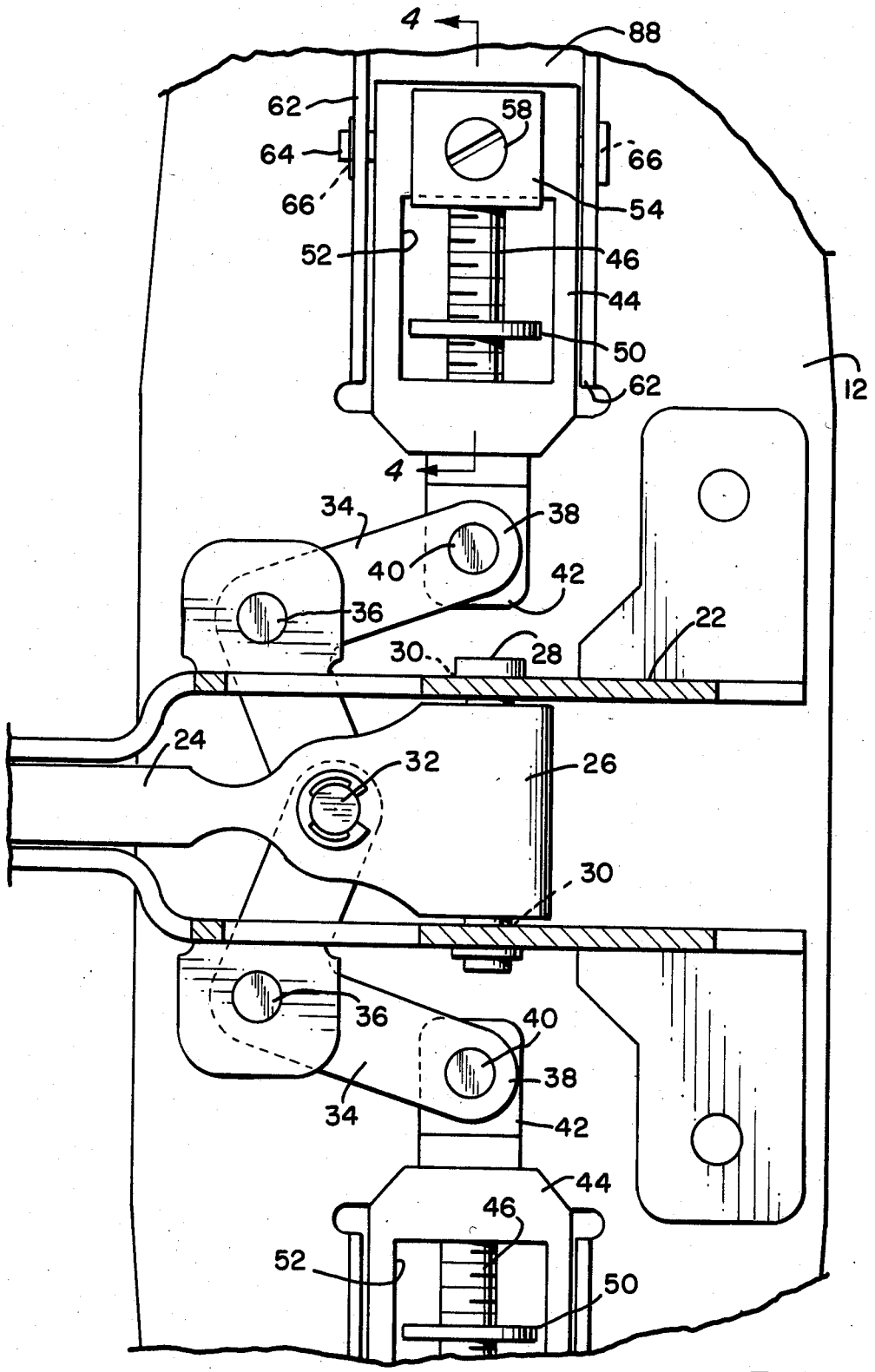
FIG. 2 is a vertical illustration, in enlarged scale over that of FIG. 1, of the details of the linkage arrangement, with the top of the control link housing cut away for purposes of clarity.

As shown in the figures, the novel mechanism 10 comprises components supported on plates 12 and 14 which are mounted onto the opposite, external surfaces of a closure (not shown) such as a door. The one plate 14, known in the art as a trim plate, comprises an inner, closure-interfacing surface 16 which supports some of the operating mechanism, and the other plate 12, commonly known as the centercase, supports the remainder of the mechanism. The two plates are mounted in spaced apart disposition, on a closure, by means of four standoffs 18 (only three being visible) fixed to the first or trim plate 14, and mounted to the centercase 12. The centercase 12 has an outermost support surface 20 to which is fixed a control link housing 22. A control link 24 is slidably supported in the housing 22, and has a terminal end thereof which defines an attachment head 26. A pin 28 traverses the head 26, and slidably engages slots 30 on each side of the control link housing 22.

The manner in which the control link 24 is caused to slidably translate in the housing 22 is well known to those skilled in the relevant, panic exit mechanism art. Hence, it is deemed unnecessary to explain or illustrate the panic push bar and associated control link operating mechanisms. Such are only ancillary to the instant invention, in any event.

A pivot pin 32 mounted in the control link 24 is coupled to a pair of bellcranks 34. Intermediate portions of bellcranks 34 are pivoted, at 36, to the centercase 12. The outermost limbs 38 thereof are pivotably coupled, at 40, to tabs 42 extending from attachment blocks 44. The attachment blocks 44 are of generally rectangular conformation in plan, and substantially square in cross-section. Rotatably journalled in each is an adjustment screw 46. Elongate, latch bolt actuators 48, the same being the top rod connector **48*a* and the bottom rod connector 48*b*, have limbs 50 extending therefrom at right angles. Each of the blocks 44 has a cavity 52 formed therein, and the limbs 50 project into the cavities 52. The limbs 50 are threaded in the center, to receive the adjustment screw 46. As noted, the adjustment screws 46 are journalled in the blocks 44, and bridge across the cavities 52. The screws 46 are retained in the blocks by means of keepers 54, the latter being bifurcated, resilient clips. Intermediate the length of each screw 46, i.e., adjacent the head end, is a reduced diameter groove 56. The bifurcations of the spring clips 54 are forced onto the grooves 56. Finally set screws 58 secure the clips 54 to the blocks 44. Each adjustment screw 46 has flattened shank portions 60 which are engageable by the innermost, leading end of the associated set screw 58. Accordingly, the set screws 58 are used to secure the adjustment screws 46 in their selected positions, and to hold the keepers 54 in place on the blocks 44. By loosening and unscrewing the set screws 58, and rotating the adjustment screws 46 the limbs 50 of the rod connectors 48*a* and 48*b* translate through the cavities 52** to effect greater or lesser lengths thereof and, by this means, the latch bolts (not shown) secured to the ends of the rod connectors can be adjusted to effect an optimum engagement with their corresponding strikes (not shown).

In parallel, astride the blocks 44, the centercase 12 has a pair of slotted ribs 62. Pins 64, in traverse of the blocks 44, slidably engage the rib slots 66 and, in this way, the blocks 44 are supported for axial translation relative to the centercase 12. It will be appreciated, then, that, as the control link 24 is reciprocated (in a manner well known in the prior art), it will cause the bellcranks 34 to swing through arcs. Consequently, the blocks 44 will travel, axially, along the ribs 62 and effect a corresponding translation of the actuators 48. It is the stepless adjustment of the effective lengths of the actuators 48 which the screws 46 afford and, of course, the screws 46 are accessibly disposed on the outermost surface of the centercase 12. When in place on a closure (door, or the like), the centercase 12 will have a trim cover (not shown) fixed thereon with one or more screws. One has only to remove the latter screws, and the trim cover, to have ready access to the adjustment screws 46.

Figure 3:
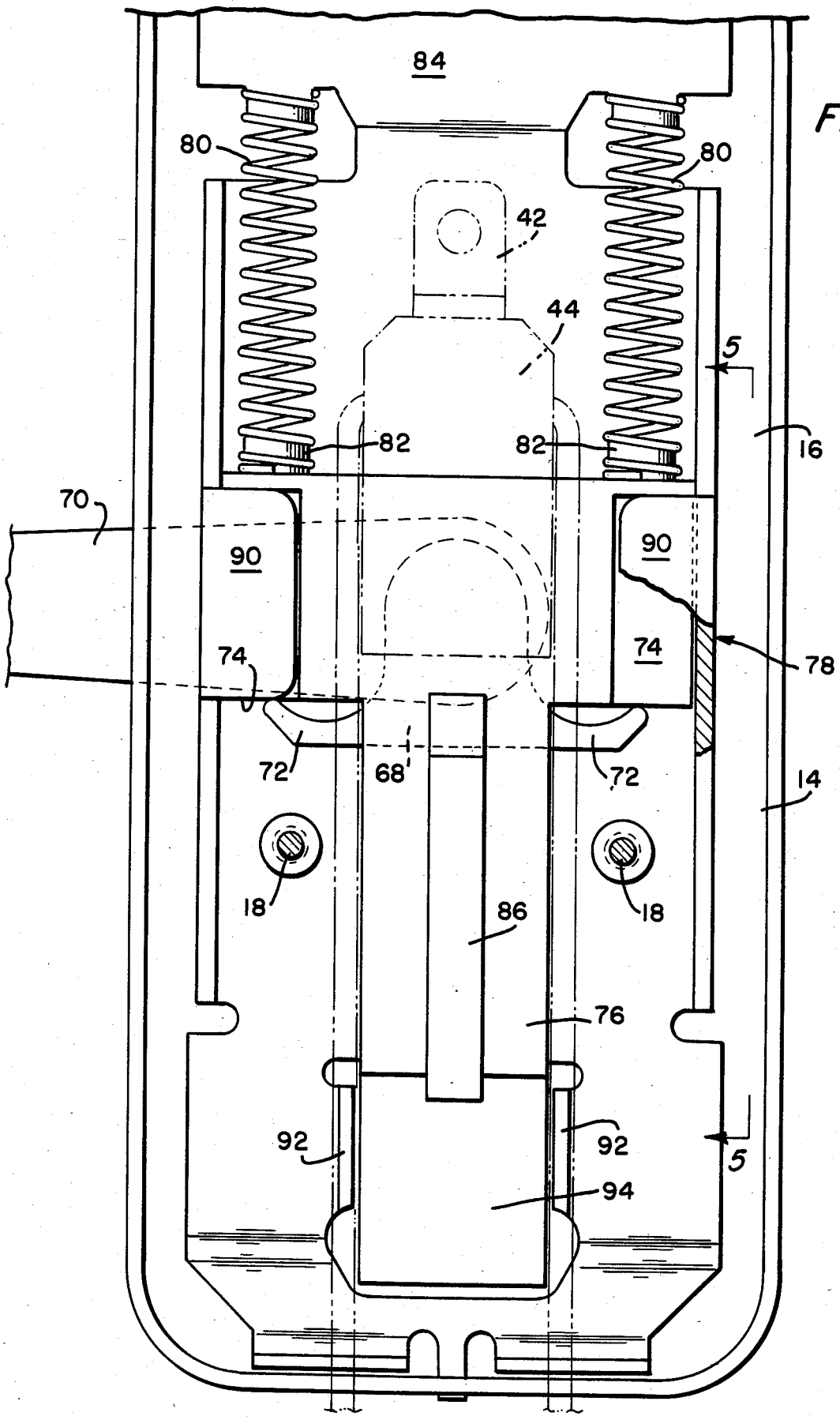
FIG. 3 is a vertical illustration, in approximately the scale of FIG. 2, of the mechanism supported by the trim plate.

Mounted on the inner, door-engaging surface 16 of the trim plate 14 is a crank 68. The latter is, in effect, the limb of an outermost door handle 70. The crank 68 is journalled in the trim plate 14, and has projecting therefrom a pair of arms 72. The arms 72 engage shoes 74 projecting from a shuttle 76 which is slidably mounted within a guideway 78 formed in the trim plate 14. A pair of compression springs 80, engaged with stubs 82 at the leading end of the shuttle 76, and a stubbed weldment 84, bias the shuttle in the position shown in FIG. 3. With rotation of the crank 68, one of the arms 72 will force a corresponding shoe 74 of the shuttle 76 upwardly (in relation to FIG. 3), and an upstanding, impingement limb 86, carried by the shuttle 76, comes into engagement with one of the attachment blocks 44 and moves the latter axially of the centercase 12. By this means then, the door handle crank 68 supported on the trim plate 14, or the control link 24 supported on the centercase 12, can actuate the mechanism. Between the ribs 62, the centercase 12 has open voids 88. The upstanding limb 86 intrudes into one of the voids 88 for travel therethrough until it comes into contacting engagement with the block 44 thereadjacent. As noted, the shuttle 76 is slidably engaged with a guideway 78 in order to translate the limb 86. The guideway 78 comprises a pair of tabs 90 which overlie the shoes 74, and a pair of parallel tracks 92 which, therebetween, slidably guide the tail 94 of the shuttle 76.

While I have described my invention in connection with a specific embodiment thereof, it is to be clearly understood that this is done only by way of example and not as a limitation to the scope of my invention as set forth in the objects thereof and in the appended claims.

I claim:

1. An operating mechanism for a closure latching assembly, comprising:

a support plate, having a longitudinal axis, for mounting thereof onto an external surface of a closure, such as a door, gate, bulkhead, or the like; wherein said plate also has an inner, closure-interfacing and closure-engaging surface, and an outer, opposite, support surface;

an elongate, latch bolt-actuating element; an attachment block;

means coupling said block, slidably, to one of said surfaces to accommodate movement of said block axially of said plate; and means attaching said element removably to said block, in a given disposition relative to said block, for movement of said element in common with said block; wherein said attaching means includes adjusting means, accessibly disposed on said outer, support surface, selectively movable, relative to said block, for effecting relative movement, between said element and said block, for adjustably positioning said element, relative to said block, in selected dispositions other than said given disposition; and said adjusting means, said block, and said element have means mutually cooperative for causing relative movement between said element and said block coincident with movement of said adjusting means relative to said block; said block has a cavity formed therein; said element has a limb disposed in said cavity; and said adjusting means comprises an adjustment screw engaged with said block which (a) protrudes into said cavity, and (b) engages said limb.

2. An operating mechanism, according to claim 1, wherein:

said adjusting means comprises an adjustment screw carried by said block and engaged with said element.

3. An operating mechanism, according to claim 1, wherein:

said adjusting means comprises an adjustment screw journaled in said block;

said element has a threaded aperture formed therein; and said screw is threadedly engaged with said aperture.

4. An operating mechanism, according to claim 1, wherein:

said plate has means defining a guideway;

said guideway having a pair of parallel ribs;

said ribs having elongate slots formed therein;

said block is slidably nested between said ribs;

said block has a pin hole formed therethrough; and a pin, slidably disposed in said pin hole, has opposite ends thereof engaged with said slots.

5. An operating mechanism, according to claim 1, wherein:

said plate has a control link coupled thereto for translation thereof normal to said axis;

a bellcrank pivotably coupled to said plate; wherein one end of said bellcrank is pivotably coupled to said link, and the other end thereof is pivotably coupled to said block.

6. An operating mechanism, according to claim 1, wherein:

said plate has a control link coupled thereto for translation thereof normal to said axis, between first and second given positions; and means coupling said link and said block to cause said block slidably to move in a first axial direction, upon said link translating from one of said first and second positions to the other thereof, and to move in an opposite, axial direction upon said link translating from said other position to said one position.

7. An operating mechanism, according to claim 1, further including:

a trim plate having an axis parallel with said longitudinal axis, for mounting thereof onto an external surface of a closure; wherein said trim plate also has an inner, closure-interfacing and closure-engaging surface, and an outer, opposite support surface; and a shuttle; wherein said shuttle and said trim plate together comprise means connecting said shuttle, slidably, to one of said surfaces of said trim plate to accommodate movement of said shuttle axially of said trim plate;

said shuttle having means engageable with said block for moving said block coincident with movement of said shuttle.

8. An operating mechanism, according to claim 7, wherein:

said connecting means comprises a guideway formed on said one surface of said trim plate, and shoes, formed on said shuttle, slidably engaged with said guideway.

9. An operating mechanism, according to claim 7, wherein:

said shuttle is slidable, axially of said trim plate, between first and second given positions; and further including means coupled to said trim plate biasing said shuttle in one of said first and second positions.

10. An operating mechanism, according to claim 9, further including:

a crank, journaled in said trim plate, and engaging said shuttle, manipulative for moving said shuttle from said one position thereof to the other of said first and second positions.

11. An operating mechanism, according to claim 3, wherein:

said block has a cavity formed therein;

said cavity having opposed, end walls;

said element has a limb interposed in said cavity intermediate said walls;

said threaded aperture is formed in said limb;

and said screw is journaled in said walls.

12. An operating mechanism, according to claim 11, wherein:

said end walls have boreholes formed therethrough;

opposite ends of said screw are journaled in said boreholes;

said screw further has a flat bearing surface formed therein intermediate the ends thereof;

said block has a tapped hole formed therein which opens onto said bearing surface; and further including a set screw threadedly engaged with said hole for lockingly engaging said bearing surface to secure said screw against rotation.

13. An operating mechanism, according to claim 3, further including:

a keeper, removably attached to said block, having means, engaged with said screw, securing said screw against removal from said block.

14. An operating mechanism, according to claim 13, wherein:

said screw has a recess formed therein; and said keeper comprises a resilient clip engaged with said recess.

* * * * *